US009635932B2

(12) United States Patent
Kelley et al.

(10) Patent No.: US 9,635,932 B2
(45) Date of Patent: May 2, 2017

(54) HEIGHT ADJUSTABLE DESK SYSTEM

(71) Applicant: Assa Group, Inc., Lowell, MI (US)

(72) Inventors: Mike R. Kelley, Coopersville, MI (US); Ryan D. Sullivan, Grand Rapids, MI (US); Dante M. Zeppa, Grand Rapids, MI (US)

(73) Assignee: Assa Group, Inc., Lowell, MI (US)

( * ) Notice: Subject to any disclaimer, the term of this patent is extended or adjusted under 35 U.S.C. 154(b) by 0 days.

(21) Appl. No.: 15/181,943

(22) Filed: Jun. 14, 2016

(65) Prior Publication Data

US 2016/0360879 A1 Dec. 15, 2016

Related U.S. Application Data

(60) Provisional application No. 62/175,359, filed on Jun. 14, 2015.

(51) Int. Cl.

| | |
|---|---|
| ***A47B 21/00*** | (2006.01) |
| ***A47B 21/06*** | (2006.01) |
| ***A47B 21/02*** | (2006.01) |
| ***H05K 5/02*** | (2006.01) |

(52) U.S. Cl.

CPC ..... *A47B 21/06* (2013.01); *A47B 21/02* (2013.01); *H05K 5/0213* (2013.01); *A47B 2021/066* (2013.01); *A47B 2200/0052* (2013.01); *A47B 2200/0082* (2013.01)

(58) Field of Classification Search

CPC ..... A47B 21/06; A47B 21/02; A47B 9/02; A47B 9/20; A47B 2021/062; A47B 2021/064; A47B 2021/066; A47B 2021/068

See application file for complete search history.

(56) References Cited

U.S. PATENT DOCUMENTS

| | | | | |
|---|---|---|---|---|
| 6,183,280 | B1 * | 2/2001 | Laukhuf | A47B 21/06 439/214 |
| 6,286,441 | B1 * | 9/2001 | Burdi | A47B 9/00 108/147 |
| 6,293,506 | B1 * | 9/2001 | Gutgsell | A47B 21/06 108/50.01 |
| 6,960,098 | B1 * | 11/2005 | Tseng | A47B 21/06 108/50.02 |

(Continued)

*Primary Examiner* — Daniel Rohrhoff

(74) *Attorney, Agent, or Firm* — Oppenhuizen Law PLC; David L. Oppenhuizen

(57) ABSTRACT

A height-adjustable desk having a desktop, at least one cabinet positioned beneath the desktop, and at least one height-adjustable column. The height-adjustable column has an upper end secured to the desktop and a lower end secured within the cabinet. The height-adjustable column is selectively raised or lowered to move the desktop up or down. The cabinet has a storage compartment, and the lower end of the column is positioned behind the storage compartment. Substantially the entire length of the height-adjustable column is housed within and concealed by the cabinet when the height-adjustable column is in the lower position. The desk also includes various cable management channels and cable tracks to entirely conceal all electrical cable running throughout the desk to power and control the height of the desk, as well as to provide electrical power or other necessary electrical cables for any electrical equipment used on the desktop.

20 Claims, 7 Drawing Sheets

(56) References Cited

U.S. PATENT DOCUMENTS

| | | | | |
|---|---|---|---|---|
| 2002/0043183 | A1* | 4/2002 | Insalaco | A47B 21/06 108/50.02 |
| 2008/0224582 | A1* | 9/2008 | Boland | A47B 21/06 312/330.1 |
| 2009/0013908 | A1* | 1/2009 | Grove | A47B 1/05 108/159.11 |
| 2010/0288168 | A1* | 11/2010 | Rheault | A47B 13/10 108/28 |
| 2011/0155023 | A1* | 6/2011 | Krause | A47B 17/00 108/26 |
| 2013/0204438 | A1* | 8/2013 | Hjelm | G05B 15/02 700/275 |
| 2015/0155666 | A1* | 6/2015 | Rosenblum | H01R 25/006 439/32 |

* cited by examiner

HEIGHT ADJUSTABLE DESK SYSTEM

CROSS REFERENCE TO RELATED APPLICATION

This application claims the benefit of U.S. Provisional Application 62/175,359, which was filed on Jun. 14, 2015, the disclosure of which is hereby incorporated by reference.

BACKGROUND OF THE INVENTION

1. Field of the Invention

The present invention pertains to a height adjustable desk. More particularly, the present invention pertains to a height adjustable desk that includes integrated storage, as well as wire and cable management.

2. Description of the Prior Art

Workstations used by employees in an office environment have evolved over the years. Originally, each employee used an individual desk. Those desks were then replaced by re-configurable systems furniture, which is commonly known as "cubicles." Cubicles have now given way to benching or "linked benching," in which workstations are aligned end-to-end with each other and each row of workstations may optionally be positioned to face against another row.

Another evolution of the office workstation has been to make the height of a desktop adjustable so that the user can selectively sit or stand while working, or to accommodate chairs of different heights. However, there are several drawbacks to using a height-adjustable desk. First, many of the height-adjustable desks available are actually more akin to a table having an adjustable height. These include separate drawers or cabinets positioned below the table to provide storage for the user's equipment and/or documents. In addition, any electronics sitting atop the surface of the workstation, such as a computer, monitor, phone, etc., will have electrical cords extending off the edge of the desktop to reach a power source or other electronics equipment. This can also lead to problems with electrical cables being snagged, caught, or pinched as the desk is raised or lowered. In addition, the resulting product may have a muddled and unrefined look due to the modular storage cabinets and numerous visible electrical cables.

The present invention seeks to improve upon the prior art by providing a desk that is suitable for linked benching that is height-adjustable, includes integrated storage cabinets for housing drawers, and includes an integrated cable management and storage system for concealing and managing the extension and retraction of necessary cables. Furthermore, the present invention also provides a plurality of such desks that can be used to provide a linked benching system having a plurality of aligned desks.

SUMMARY OF THE INVENTION

The present invention is directed to workstations or multi-user desk systems with height adjustable work surfaces that are controlled manually by a user, such as by a keypad located on the workstation, or remotely by a computing device like a phone or a tablet. The workstations or systems can be made available in stand-alone or benching applications. The workstations or systems include electrically-powered motors that are housed in the workstations and control height-adjustable columns which are anchored in base supports. The workstations or systems can include multiple storage drawers housed within the height-adjustable desktop and/or cabinets positioned near the floor beneath the desktop.

The workstations or systems can also have ventilated drawers to house electronic equipment. For example, a drawer in the desktop can include a laptop docking station. In addition, the work surface can include at least one electrical outlet (e.g., a power outlet, a USB power outlet, a LAN outlet, etc.) positioned on the work surface to provide a wired connection for electronic equipment positioned atop the work surface. All wires for power and accessories extend through hidden channels in the height-adjustable columns and the desktop, and plug into wiring spines, or cable management channels, mounted within the desk to provide a clean aesthetic appearance of the workstations or systems.

Drawers may also be incorporated within the height-adjustable desktop. The desktop may be raised or lowered using a manual input from a user. This manual input could be a switch or keypad positioned on the desk. Alternatively, it could be remotely controlled by a computing device (e.g., a phone or tablet) or a dedicated remote control device using any suitable technology that is well-known in the art, including a Wi-Fi connection, Bluetooth®, RFDI scanner, infrared light, and so forth.

More specifically, the present invention provides a height-adjustable desk comprising: (a) a desktop having an upper work surface; (b) at least one cabinet positioned beneath a portion of the desktop, the cabinet including at least one storage compartment; and (c) at least one height-adjustable column that is selectively raised into an upper position or lowered into a lower position, the height-adjustable column having an upper end and a lower end, and the lower end is secured within the cabinet, and the upper end is secured to the desktop.

The height-adjustable column can include a column channel extending along the length thereof through which electrical cables or wiring can pass to provide electrical power to the desktop. The electrical cable extends through the column channel, whereby a first end of the electrical cable is located at the desktop and can be electrically connected with an object at the desktop, and the electrical cable has a second end that can be electrically connected to a remote electrical connection.

Preferably the lower end of the height-adjustable column is positioned behind, and not within the storage compartment. In addition, preferably substantially the entire length of the height-adjustable column is housed within and concealed by the cabinet when the height-adjustable column is in the lower position.

According to a second embodiment of the present invention, there is provided a height-adjustable desk comprising: (a) a desktop having an upper work surface; (b) at least one height-adjustable column that is selectively raised into an upper position or lowered into a lower position, the height-adjustable column having an upper end and a lower end, and the lower end is secured to a base of the desk, and the upper end is secured to the desktop; (c) a column channel extending along the length of the height-adjustable column, the column channel having a top end that is secured to the height-adjustable column proximate to the upper end thereof, and a bottom end that is secured to the height-adjustable column proximate to the lower end thereof; and (d) at least one electrical cable that extends through the column channel, whereby a first end of the electrical cable is located at the desktop and can be electrically connected with an object at the desktop, and the electrical cable has a second end that can be electrically connected to a remote electrical connection not on the desk.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
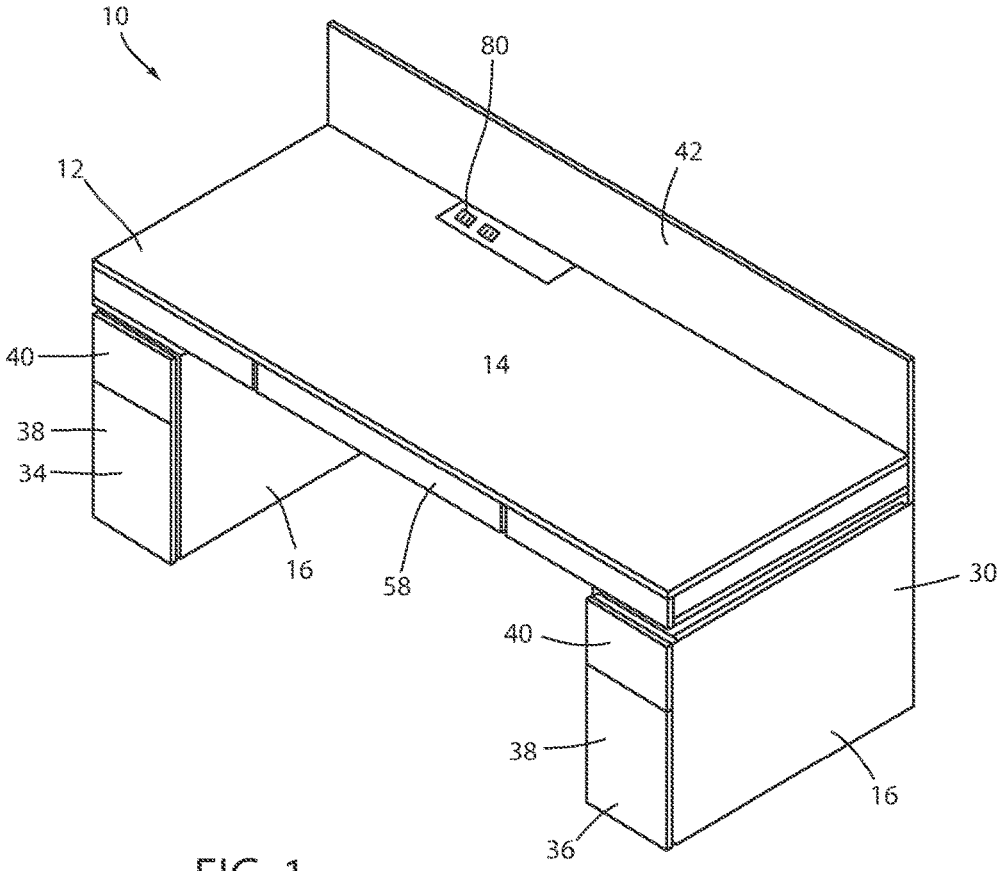
FIG. 1 is a perspective view of a first embodiment of the present invention hereof.
Figure 2:
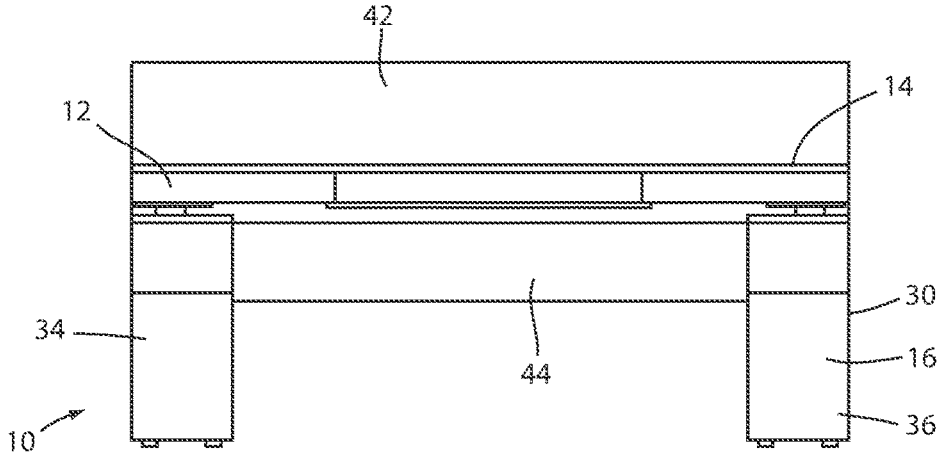
FIG. 2 is a front view of a workstation showing the desktop in a lowered position.
Figure 3:
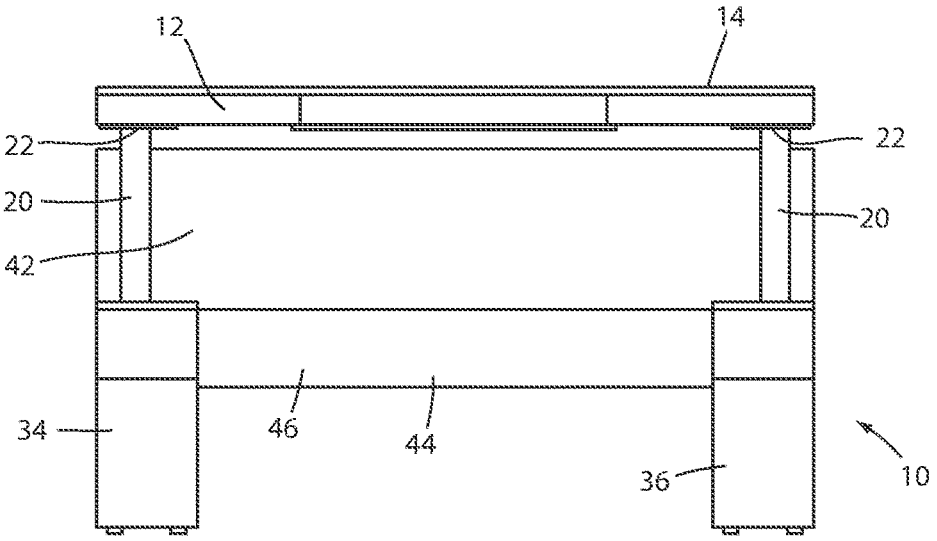
FIG. 3 is a front view of a workstation showing the desktop in a raised position.
Figure 4:
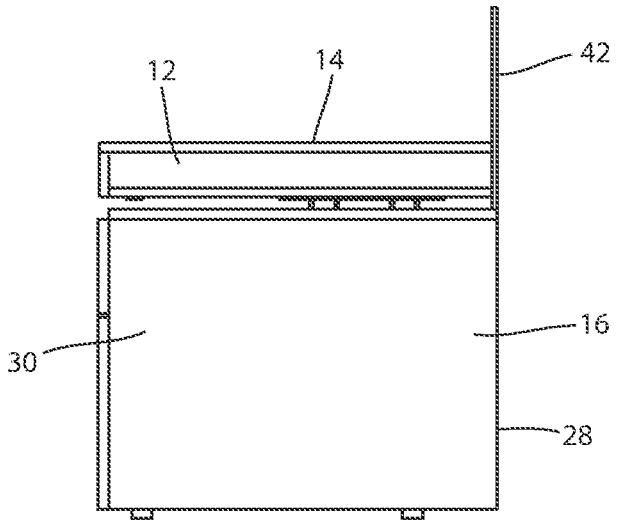
FIG. 4 is a side view of a workstation showing the desktop in a lowered position.
Figure 5:
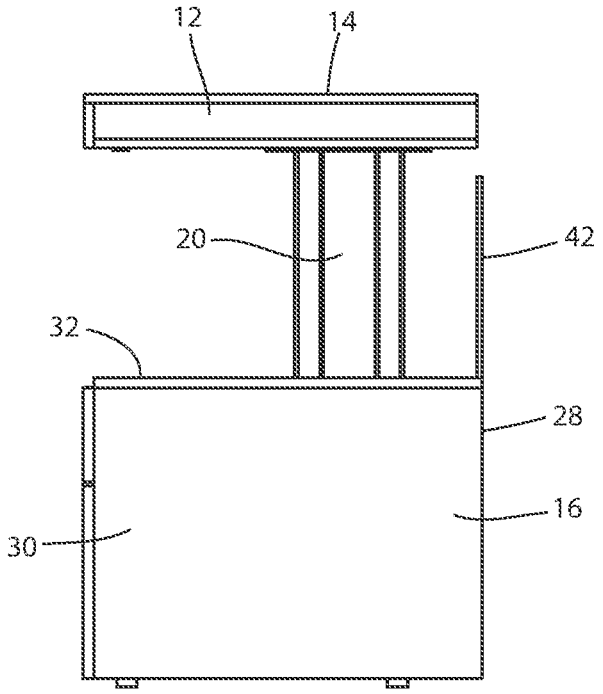
FIG. 5 is a side view of a workstation showing the desktop in a raised position.
Figure 6:
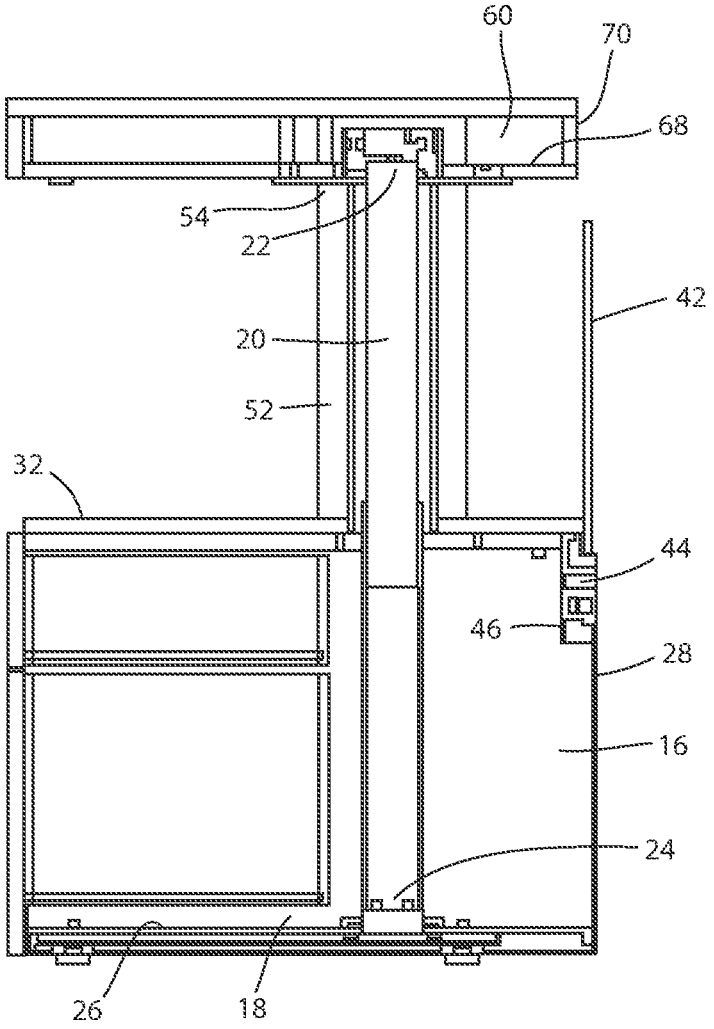
FIG. 6 is a side sectional view showing internal components of the workstation with the desktop in a raised position.
Figure 7:
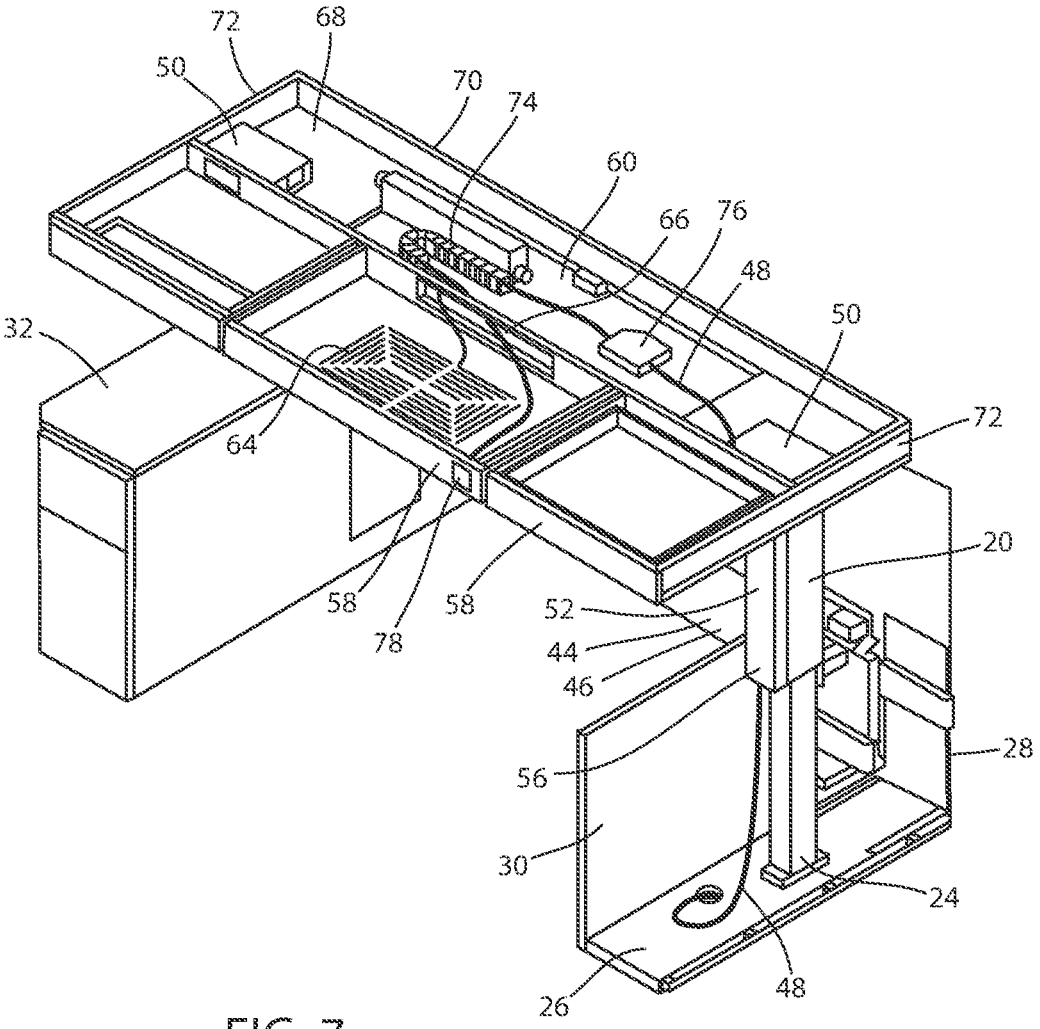
FIG. 7 is a perspective view of the workstation with the desktop in a raised position and having a portion of the cabinet and the work surface removed to show internal components of the workstation.
Figure 8:
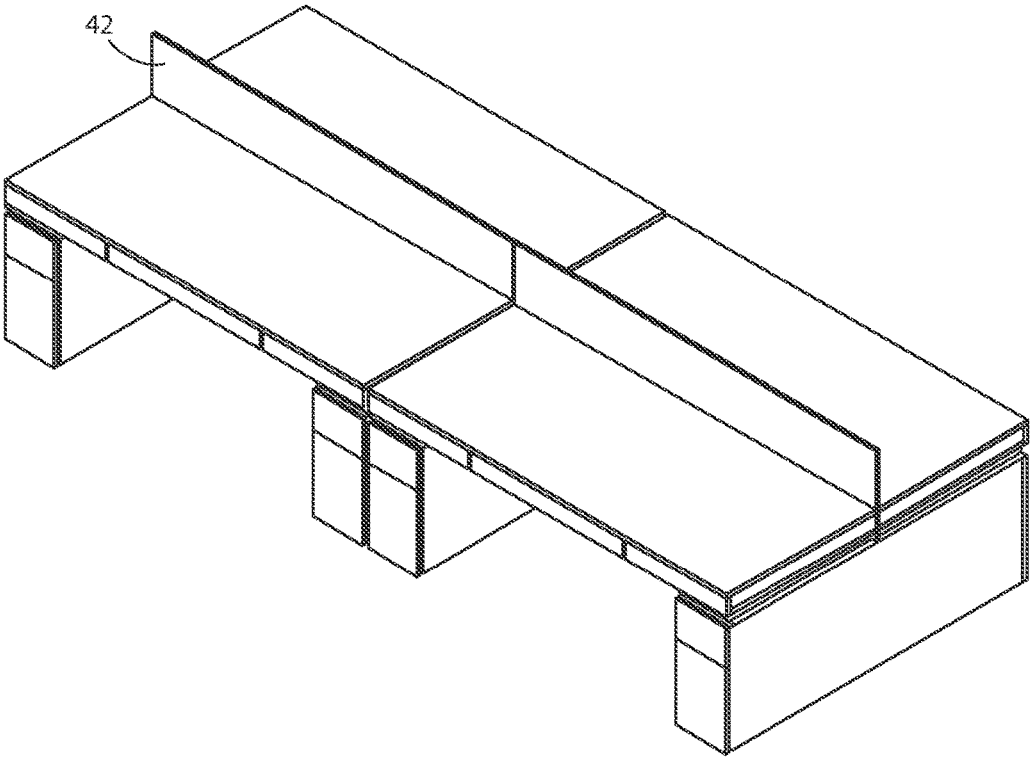
FIG. 8 is a perspective view of several workstations arranged in a linked benching configuration to form a workstation system.
Figure 9:
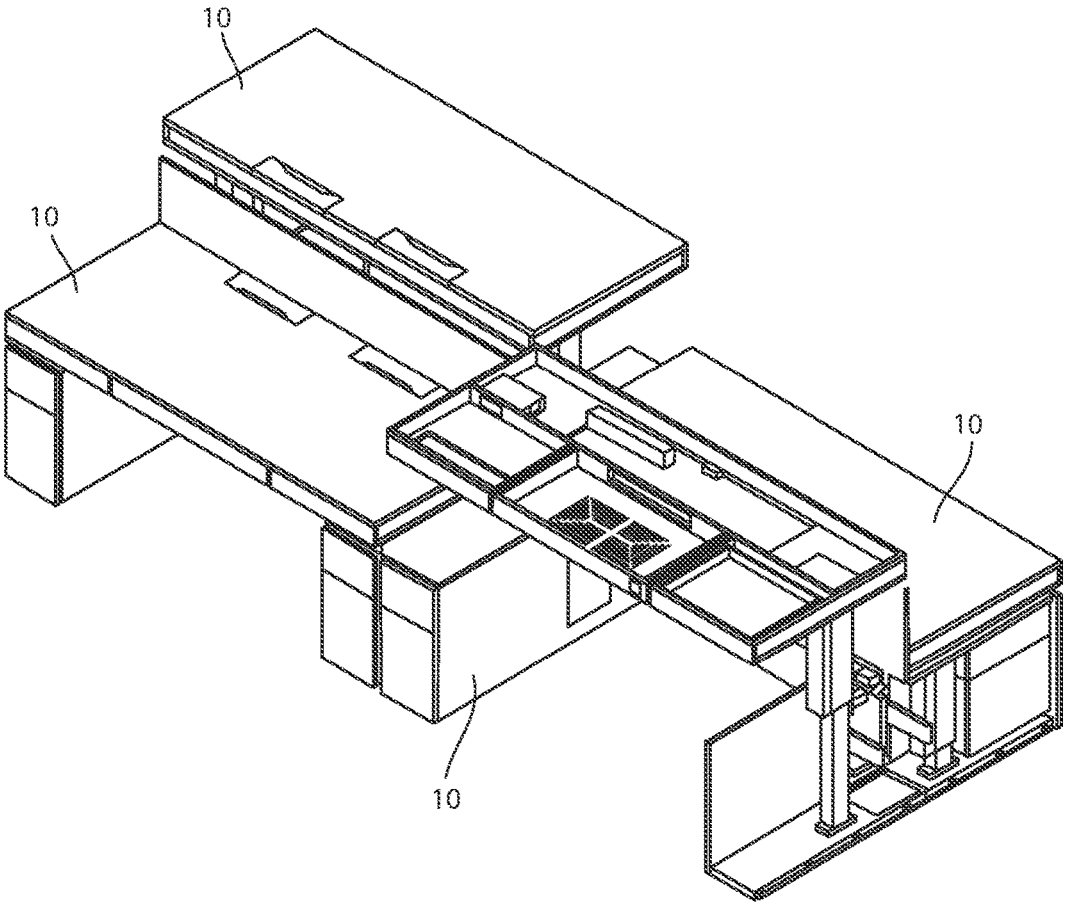
FIG. 9 is a perspective view showing several workstations arranged in a linked benching configuration and showing the desktop of two of the workstations in a raised position.

In accordance with the present invention and as shown generally in FIG. 1, there is provided a height-adjustable desk 10 comprising: (a) a desktop 12 having an upper work surface 14; (b) at least one cabinet 16 positioned beneath a portion of the desktop 12, the cabinet 16 including at least one storage compartment 18; and (c) at least one height-adjustable column 20 that is selectively raised into an upper position or lowered into a lower position, the height-adjustable column 20 having an upper end 22 and a lower end 24, and the lower end 24 is secured within the cabinet 16 and the upper end 22 is secured to the desktop 12.

As shown throughout the drawings, the cabinet 16 is positioned on the floor and provides a structural basis for the desktop 12. Each cabinet 16 can include a floor 26, a back wall 28, sidewalls 30, and a top wall 32 to form an enclosure. Preferably, there is provided a left cabinet 34 positioned on a left end of the desk 10, and a right cabinet 36 positioned on the right end of the desk 10.

Each cabinet 16 can optionally include one or more storage compartments 18, which can include an open-top file drawer 38, a shallow open-top drawer 40 for storing office supplies like pens, a stapler, etc., a fixed-position storage compartment that does not extend out of the cabinet 16 but is accessible by a door at the front of the cabinet 16, or any other suitable type of storage compartment 18 that is well-known in the art. As will be discussed in greater detail below, it is noted that the storage compartments 18 do not use all of the available space within the cabinet 16 because space must be left to house the height-adjustable columns 20 as well.

A divider 42 can optionally be provided which is attached to a back surface of the workstation 10 and extends upwardly to provide some degree of privacy to an individual using the workstation 10. This is particularly useful when the workstation 10 is positioned to face against another workstation 10.

The desk 10 also includes a wire spine, or cable management channel 44, that extends across the back of the desk 10 between the left cabinet 34 and the right cabinet 36. The cable management channel 44 includes a plurality of walls 46 and has an open channel extending along the length thereof to receive at least one electrical cable 48.

As mentioned above, there is provided a height-adjustable column 20 for raising or lowering the desktop 12. Any suitable type of height-adjustable column that is well-known in the art for raising or lowering the desktop on a height-adjustable desk can be used. The height-adjustable column 20 can include a worm gear or any other suitable mechanical linkage or device for raising or lowering the desktop 12. Preferably, the height-adjustable column 20 is electrically powered and includes a motor 50 for raising or lowering the height-adjustable column 20. Although specific types of height-adjustable columns 20 will vary, preferably the motor 50 is mounted at the upper end 22 of the height-adjustable column 20.

The height-adjustable column 20 has an upper end 22 and a lower end 24. The upper end 22 is secured to the desktop 12, and the lower end 24 is secured to the cabinet 16. Preferably, the lower end 24 of the height-adjustable column 20 is mounted to the floor 26 of the cabinet 16, and the height-adjustable column 20 extends upwardly through the cabinet 16 and through an opening in the top wall 32 of the cabinet 16. The height-adjustable column 20 is mounted to the floor 26 in the cabinet 16 behind the storage compartment 18 so that the height-adjustable column 20 is concealed within the cabinet 16 for aesthetic purposes.

In addition, it is an objective of the invention to provide a desk 10 which appears similar to a traditional desk 10 when the desktop 12 is in a lower position. Therefore, when the desktop 12 is in a fully lowered position, substantially the entire length of the height-adjustable column 20 is housed within and concealed by the cabinet 16 so that the height-adjustable column 20 is preferably not visible while in the lowered position.

The preferred embodiment of the invention shown in the drawings includes two height-adjustable columns 20: one positioned on a left end of the desk 10 and another positioned on a right end of the desk 10. However, any other suitable number of height-adjustable columns 20 can be provided, and they can be positioned at any suitable location as well. For example, only one height-adjustable column 20 could be provided and be positioned near a midpoint with the desktop 12 near the back of the workstation 10. Likewise, a workstation 10 could include three or more height-adjustable columns 20 positioned along the length of the desktop 12 if the desktop 12 is sufficiently long.

In addition to the mechanical components for actually raising or lowering the height-adjustable column 20, the height-adjustable column 20 also includes a hollow column channel 52 that extends along the length of the height-adjustable column 20. The column channel 52 includes a top end 54 and a bottom end 56. The top end 54 is secured to the height-adjustable column 20 proximate to the upper end 22 of the column 20, and the bottom end 56 is secured to the height-adjustable column 20 proximate to the lower end 24 of the column 20. The top end 54 and bottom end 56 of the column channel 52 are open. The column channel 52 can optionally include two separate pieces, one being nested within the other and each of the pieces being secured to a respective end of the height-adjustable column 20. Accordingly, the two pieces can therefore extend or retract as the height-adjustable column 20 is raised or lowered.

At least one electrical cable 48 is provided which extends through the column channel 52 so as to provide a source of electrical power to the desktop 12. The electrical cable 48 can be a power cord, a network cord for a LAN, a telephone cord, an HDMI cable, or any other type of electrical cable 48 that is well-known in the art, and for which it would be beneficial to provide access to at the desktop 12. A first end of the electrical cable 48 is located at the desktop 12 and can be electrically connected with any suitable object at the desktop 12, such as a laptop computer, telephone, or the like. The electrical cable 48 has a second end that extends out of the bottom end 56 of the column channel 52. The second end of the electrical cable 48 can connect directly to a power supply, such as plugging into an electrical outlet on the floor or wall.

When multiple workstations 10 are provided to form a system of workstations 10, then the second end of the electrical cable 48 can extend through the cable management channel 44 where it can connect with a powered electrical cable 48 in the cable management channel 44 in an adjacent workstation 10. Thus, it is seen that adjoining workstations 10 can be electrically connected to one another.

The desktop 12 includes an upper work surface 14, as well as at least one drawer 58 and a wire management cavity 60 for housing electrical cables 48 and components. The desktop 12 also includes a centrally-positioned pull-out drawer 58. Optionally the drawer 58 has a vent 64 along its bottom surface to allow the use and storage of electrical equipment within the drawer 58. As discussed further below, the back wall 28 of the drawer 58 also includes an opening 66 to permit electrical access into the wire management cavity 60, which is positioned behind the drawer 58.

Optionally, the desktop 12 can also include additional pull-out drawers 58 to the left and/or right of the centrally located pull-out drawer 58.

The desktop 12 has the upper work surface 14, a bottom floor surface 68, a back wall 70, and the pair of sidewalls 72 which define an open cavity within the desktop 12. The drawers 58 are positioned within the open cavity. In addition, the motor 50 for the height-adjustable column 20 can also be housed within the open cavity of the desktop 12 so that it is concealed.

A wire management cavity 60 is positioned within the open cavity of the desktop 12, and is provided to house and manage the electrical cables 48 and various electrical components that are necessary to raise or lower the desktop 12, as well as provide electrical power or connectivity to electrical equipment on the work surface 14. The first end of the electrical cable 48 extends out of the top end 54 of the column channel 52 where it passes into the wire management cavity 60. A cable track 74, or cable carrier, can be located within the wire management cavity 60 and connected to the back wall 70 of the drawer 58. As understood by those having ordinary skill in the art, a cable track 74 is a flexible hollow frame formed from a plurality of interlocking segments. Each segment is flexible with respect to the adjoining segments, and each segment has a hollow center to allow a cable to pass therethrough. The cable track 74 guides the electrical cable 48 passing therethrough as the cable is pushed and pulled to keep the electrical cable 48 from getting snagged or jammed.

The electrical cable 48, or one of several provided electrical cables 48, passing through the column channel 52 and up into the wire management cavity 60 provides the electricity to power the motors 50 to drive the height-adjustable columns 20 up and down. The electrical cable 48 is electrically connected to a controller 76 within the wire management cavity 60. The controller 76 is electrically connected to the motor 50 of the height-adjustable column 20 to control when the motor 50 is powered, and whether the height-adjustable column 20 is being raised or lowered.

There is also provided a manual input 78 interface for providing instructions to the controller 76. The input 78 is electrically connected to the controller 76, and allows a user to manually instruct the desktop 12 to be raised or lowered. The input 78 can be a keypad provided on the desktop 12 (or on the bottom of the floor surface 68 or along the sidewall 72 of the desktop 12). Alternatively, the input 78 can also be provided via a remote device, such as a computer, tablet, a phone, or a dedicated remote control, as is disclosed in U.S. Patent App. Pub. No. 2013/0204438 to Hjelm, the entire disclosure of which is hereby incorporated by reference. The wireless signal can be sent from the remote input 78 device to a receiver in the desktop 12 using any suitable type of wireless connection, including but not limited to, a Wi-Fi connection, Bluetooth®, RFDI scanner, infrared light, or the like.

Lastly, the desktop 12 includes at least one electrical interface connector 80 positioned on the work surface 14 to provide convenient access for any electrical equipment positioned on the work surface 14. The electrical interface connector 80 can be an electrical outlet, a USB port, a phone jack, a LAN connection, an HDMI connection, or any other suitable type of electrical connector that would be useful to provide for objects on the work surface 14. The electrical interface connector 80 is electrically connected to an electrical cable 48 that extends up through the column channel 52.

As mentioned above, the workstation 10 has particular applicability when multiple workstations 10 are provided and positioned end-to-end and back-to-back in a linked benching arrangement. For example, when the workstations 10 are provided in this manner, the appropriate electrical cables 48 can be routed through the cable management channels 44 along the back of the workstations 10 to electrically link one workstation 10 to another. This linking functionality helps conceal the electrical cables 48, which is a significant objective of the present invention.

According to the invention described above, a workstation is provided which provides for a height-adjustable desk that includes internal channels for routing electrical cables to conceal the electrical cables for aesthetic and ergonomic purposes, and which has the appearance and storage capabilities of a traditional desk.

As is apparent from the preceding, the present invention provides a workstation or desk that is suitable for linked benching that is height-adjustable, includes integrated storage cabinets for housing drawers, and includes an integrated cable management and storage system for concealing and managing the extension and retraction of necessary cables. Furthermore, the present invention also provides a plurality of such desks that can be used to provide a linked benching system including a plurality of aligned desks.

What is claimed is:

1. A height-adjustable desk comprising:

a desktop having an upper work surface;

at least one cabinet positioned beneath a portion of the desktop, the cabinet including at least one storage compartment;

at least one height-adjustable column that is selectively raised into an upper position or lowered into a lower position, the height-adjustable column having an upper end and a lower end, and the lower end is secured within the cabinet and the upper end is secured to the desktop; and a column channel having a top end that is secured to the height-adjustable column proximate to the upper end thereof, and a bottom end that is secured to the height-adjustable column proximate to the lower end thereof.

2. The height-adjustable desk of claim 1 wherein substantially the entire length of the height-adjustable column is housed within and concealed by the cabinet when the height-adjustable column is in the lower position.

3. The height-adjustable desk of claim 2 wherein the desktop is selectively moved into the upper position or lower position by the height-adjustable column which is powered electrically, the height-adjustable column being controlled by an input from a user.

4. The height-adjustable desk of claim 1 wherein the height-adjustable desk includes a left cabinet on a left end thereof, and a right cabinet on a right end thereof, and the height-adjustable desk includes a cable management channel configured to receive at least one electrical cable, the cable management channel extending between the left cabinet and the right cabinet to allow the electrical cable to extend between the left cabinet and the right cabinet.

5. The height-adjustable desk of claim 1 wherein the desktop includes a drawer.

6. The height-adjustable desk of claim 5 wherein the drawer is ventilated to allow the use and storage of electrical equipment within the drawer.

7. The height-adjustable desk of claim 1 wherein the desktop includes a wire management cavity that houses at least one electrical wire.

8. The height-adjustable desk of claim 7 wherein the work surface includes an electrical outlet that is electrically connected to the electrical wire in the wire management cavity.

9. The height-adjustable desk of claim 1 wherein the desktop is selectively moved into the upper position or lower position by the height-adjustable column which is powered electrically, the height-adjustable column being controlled by an input from a user.

10. The height-adjustable desk of claim 1 wherein substantially the entire length of the height-adjustable column is housed within and concealed by the cabinet when the height-adjustable column is in the lower position.

11. A height-adjustable desk comprising:

a desktop having an upper work surface;

at least one height-adjustable column that is selectively raised into an upper position or lowered into a lower position, the height-adjustable column having an upper end and a lower end, and the lower end is secured to a base of the desk and the upper end is secured to the desktop;

a column channel having a top end that is secured to the height-adjustable column proximate to the upper end thereof, and a bottom end that is secured to the height-adjustable column proximate to the lower end thereof; and at least one electrical cable that extends through the column channel, whereby a first end of the electrical cable is located at the desktop and can be electrically connected with an object at the desktop, and the electrical cable has a second end that can be electrically connected to a remote electrical connection not on the desk.

12. The height-adjustable desk of claim 11 wherein the height-adjustable desk includes a left cabinet on a left end thereof below the desktop, and a right cabinet on a right end thereof below the desktop, and the height-adjustable desk includes a cable management channel configured to receive an electrical cable, the cable management channel extending between the left cabinet and the right cabinet to allow the electrical cable to extend between the left cabinet and the right cabinet.

13. The height-adjustable desk of claim 11 wherein the desktop includes a drawer.

14. The height-adjustable desk of claim 13 wherein the drawer is ventilated to allow the use and storage of electrical equipment within the drawer.

15. The height-adjustable desk of claim 11 wherein the desktop includes a wire management cavity that houses at least one electrical wire.

16. The height-adjustable desk of claim 15 wherein the work surface includes at least one electrical outlet, whereby electrical equipment on the work surface can be electrically connected to the electrical wire in the wire management cavity via the electrical outlet.

17. The height-adjustable desk of claim 11 wherein the desktop is selectively moved into the upper position or lower position by the height-adjustable column which is powered electrically, the height-adjustable column being controlled by an input from a user.

18. The height-adjustable desk of claim 17 wherein the input is connected wirelessly to the desk.

19. A height-adjustable desk comprising:

a desktop having an upper work surface;

at least one cabinet positioned beneath a portion of the desktop, the cabinet including at least one storage compartment; and at least one height-adjustable column that is selectively raised into an upper position or lowered into a lower position, the height-adjustable column having an upper end and a lower end, and the lower end is secured within the cabinet and the upper end is secured to the desktop, and the lower end of the height-adjustable column is positioned behind, and not within, the storage compartment.

20. The height-adjustable desk of claim 19 wherein substantially the entire length of the height-adjustable column is housed within and concealed by the cabinet when the height-adjustable column is in the lower position.

* * * * *